US009279429B2

(12) United States Patent
Hancock

(10) Patent No.: US 9,279,429 B2
(45) Date of Patent: Mar. 8, 2016

(54) BLOWER HOUSING

(71) Applicant: Trane International Inc., Piscataway, NJ (US)

(72) Inventor: Stephen S. Hancock, Flint, TX (US)

(73) Assignee: Trane International Inc., Piscataway, NJ (US)

( * ) Notice: Subject to any disclaimer, the term of this patent is extended or adjusted under 35 U.S.C. 154(b) by 0 days.

(21) Appl. No.: 14/715,254

(22) Filed: May 18, 2015

(65) Prior Publication Data

US 2015/0252817 A1 Sep. 10, 2015

Related U.S. Application Data

(63) Continuation of application No. 13/530,823, filed on Jun. 22, 2012, now Pat. No. 9,039,363.

(51) Int. Cl.

| | |
|---|---|
| ***F04D 17/10*** | (2006.01) |
| ***F04D 29/42*** | (2006.01) |
| ***F04D 29/44*** | (2006.01) |

(52) U.S. Cl.

CPC ..... *F04D 29/424* (2013.01); *F04D 17/10* (2013.01); *F04D 29/4226* (2013.01); *F04D 29/441* (2013.01)

(58) Field of Classification Search

CPC ... F04D 17/10; F04D 29/4226; F04D 29/424; F04D 29/441

See application file for complete search history.

(56) References Cited

U.S. PATENT DOCUMENTS

| | | | |
|---|---|---|---|
| 2,322,357 | A | 6/1943 | Hagen |
| 3,407,995 | A | 10/1968 | Kinsworthy |

(Continued)

FOREIGN PATENT DOCUMENTS

| | | | |
|---|---|---|---|
| CN | 2874089 | Y | 2/2007 |
| CN | 101595310 | A | 12/2009 |

(Continued)

OTHER PUBLICATIONS

Hancock, Stephen S.; U.S. Appl. No. 13/530,823, filed Jun. 22, 2012, Title: Blower Housing.

(Continued)

*Primary Examiner* — Igor Kershteyn

(74) *Attorney, Agent, or Firm* — Conley Rose, P.C.; J. Robert Brown, Jr.; Michael J. Schofield

(57) ABSTRACT

A blower housing has a discharge direction, an axis of rotation, a polar axis that intersects the axis of rotation and is substantially perpendicular to the discharge direction, and an angular sweep of increasing fluid flow area. The fluid flow area, A, increases with increasing angular magnitude, Φ, as a function comprising at least a functional component that is at least one of (1) equal to, (2) substantially mathematically reducible to, and (3) substantially mathematically analogous to the equation, $$A(\Phi) = A_{co} + R\left(1 - \sqrt{1 - \left[\frac{(r_i)(\Phi)}{R}\right]^2}\right),$$

where $A_{co}$ is a minimum fluid flow area, R is a radius of a first circle, and $r_i$ is a radius of a second circle that is smaller than the first circle.

20 Claims, 10 Drawing Sheets

(56) References Cited

U.S. PATENT DOCUMENTS

| | | | | |
|---|---|---|---|---|
| 4,014,625 | A | 3/1977 | Yamamoto | |
| 4,872,809 | A | 10/1989 | Addie et al. | |
| 5,156,524 | A | 10/1992 | Forni | |
| 5,257,904 | A * | 11/1993 | Sullivan | F04D 29/4233 415/206 |
| 5,741,118 | A | 4/1998 | Shinbara et al. | |
| 5,997,246 | A * | 12/1999 | Humbad | F04D 29/667 415/206 |
| 6,050,772 | A | 4/2000 | Hatakeyama et al. | |
| 6,142,732 | A | 11/2000 | Chou et al. | |
| 6,273,679 | B1 | 8/2001 | Na | |
| 6,439,839 | B1 | 8/2002 | Song et al. | |
| 6,802,699 | B2 * | 10/2004 | Mikami | F04D 29/4226 415/206 |
| 7,001,140 | B2 | 2/2006 | Hustvedt et al. | |
| 7,014,422 | B2 | 3/2006 | Hancock | |
| 7,144,219 | B2 | 12/2006 | Hancock | |
| 7,168,917 | B2 | 1/2007 | Bronaugh et al. | |
| D537,517 | S | 2/2007 | Hancock | |
| 7,206,724 | B2 | 4/2007 | Chen | |
| 7,591,633 | B2 | 9/2009 | Hancock | |
| 2007/0212218 | A1 | 9/2007 | Seki et al. | |
| 2008/0257336 | A1 | 10/2008 | Hancock | |
| 2013/0142615 | A1 | 6/2013 | Hancock | |

FOREIGN PATENT DOCUMENTS

| | | | |
|---|---|---|---|
| CN | 102182707 | A | 9/2011 |
| CN | 202520656 | U | 11/2012 |

OTHER PUBLICATIONS

Chinese Office Action; Application No. 201310252718.5; Apr. 28, 2015; 11 pages.

Notice of Allowance dated Feb. 23, 2015; U.S. Appl. No. 13/530,823, filed Jun. 22, 2012; 12 pages.

* cited by examiner

BLOWER HOUSING

CROSS-REFERENCE TO RELATED APPLICATIONS

This is a continuation application of the prior filed and co-pending U.S. patent application Ser. No. 13/530,823 filed on Jun. 22, 2012 by Stephen S. Hancock, entitled "Blower Housing," the disclosure of which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and air conditioning systems (HVAC systems) sometimes comprise blower housings that contribute to delivery of diffused air.

SUMMARY OF THE DISCLOSURE

In some embodiments, a blower housing is provided that comprises a discharge direction, an axis of rotation, a polar axis that intersects the axis of rotation and is substantially perpendicular to the discharge direction, and an angular sweep of increasing fluid flow area. The fluid flow area, A, increases with increasing angular magnitude, Φ, as a function comprising at least a functional component that is at least one of (1) equal to, (2) substantially mathematically reducible to, and (3) substantially mathematically analogous to the equation, $$A(\Phi) = A_{co} + R\left(1 - \sqrt{1 - \left[\frac{(r_i)(\Phi)}{R}\right]^2}\right),$$

where $A_{co}$ is a minimum fluid flow area, R is a radius of a first circle, and $r_i$ is a radius of a second circle that is smaller than the first circle.

In other embodiments, a method of moving fluid is provided that comprises receiving fluid into a centrifugal blower and moving the fluid along an angular path of increasing fluid flow area, wherein the fluid flow area, A, increases with increasing angular magnitude, Φ, as a function comprising at least a functional component that is at least one of (1) equal to, (2) substantially mathematically reducible to, and (3) substantially mathematically analogous to the equation, $$A(\Phi) = A_{co} + R\left(1 - \sqrt{1 - \left[\frac{(r_i)(\Phi)}{R}\right]^2}\right),$$

and wherein $A_{co}$ is a minimum fluid flow area, R is a radius of a first circle, and $r_i$ is a radius of a second circle that is smaller than the first circle.

In yet other embodiments, a blower housing is provided that comprises a first sidewall comprising a first inlet, a second sidewall substantially opposite the first sidewall, the second sidewall comprising a second inlet, a radial wall joining the first sidewall to the second sidewall, the radial wall comprising a discharge, a discharge direction, and a polar axis that intersects an axis of rotation of the blower housing and extends substantially perpendicular to the discharge direction. The fluid flow area, A, of the blower housing may be increased with increasing angular position, Φ, over a first angular sweep as a function comprising at least a functional component that is at least one of (1) equal to, (2) substantially mathematically reducible to, and (3) substantially mathematically analogous to the equation, $$A(\Phi) = A_{co} + R\left(1 - \sqrt{1 - \left[\frac{(r_i)(\Phi)}{R}\right]^2}\right),$$

wherein $A_{co}$ is a minimum fluid flow area, R is a radius of a first circle, and $r_i$ is a radius of a second circle that is smaller than the first circle.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Some HVAC systems comprise centrifugal blowers that discharge air at sufficient mass flow rates but with less than desirable fluid flow characteristics. In some cases, although a required mass flow rate may be achieved, an airstream discharged from a centrifugal blower may nonetheless comprise an undesirably high level of velocity pressure as opposed to a more desirable static pressure. In some embodiments of this disclosure, centrifugal blower housings may be provided that are configured to provide improved airstream fluid flow characteristics.

Figure 1:
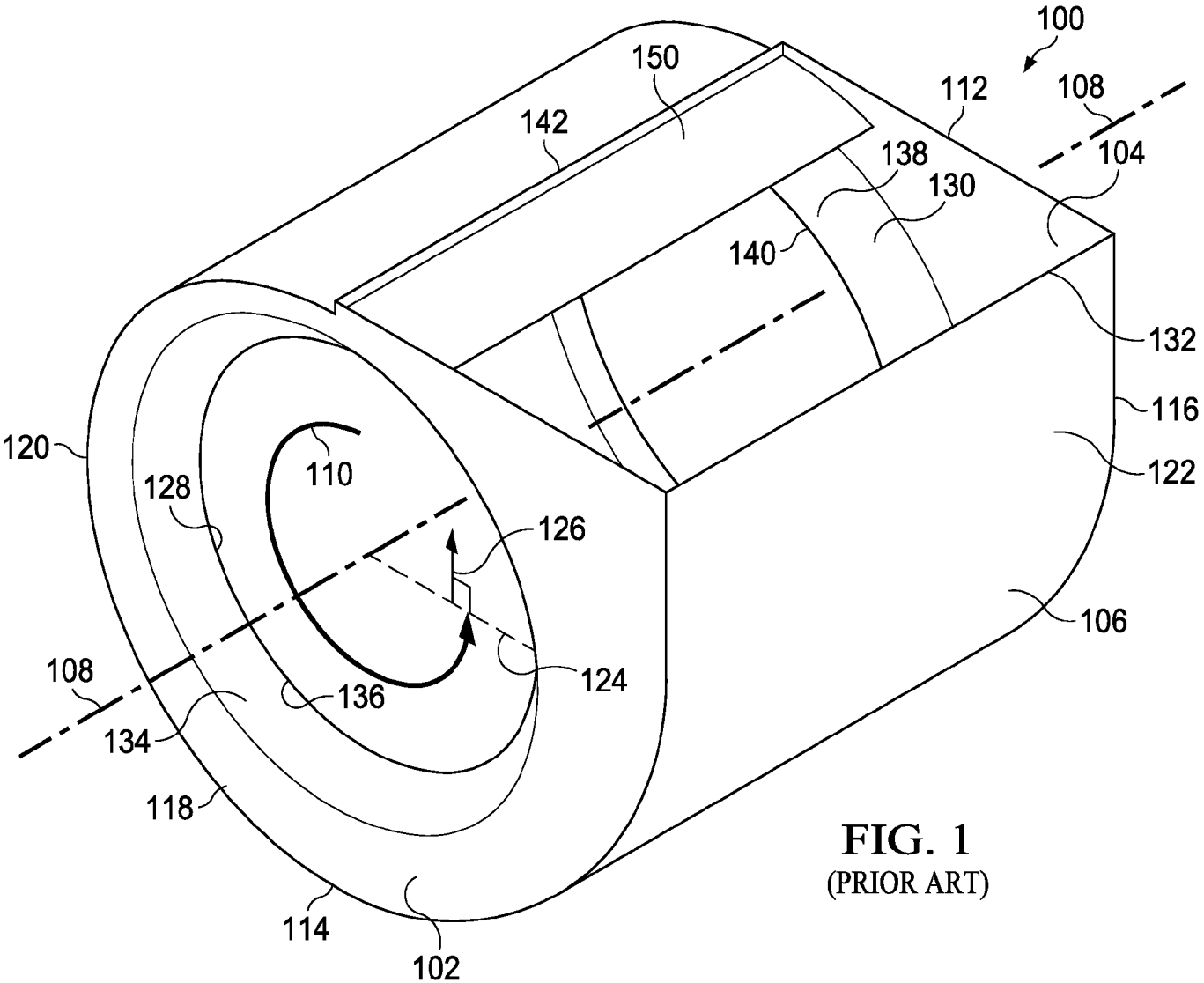
FIG. 1 (PRIOR ART)
FIG. 1 is an oblique view of a prior art blower housing according to embodiments of the disclosure.
Figure 2:
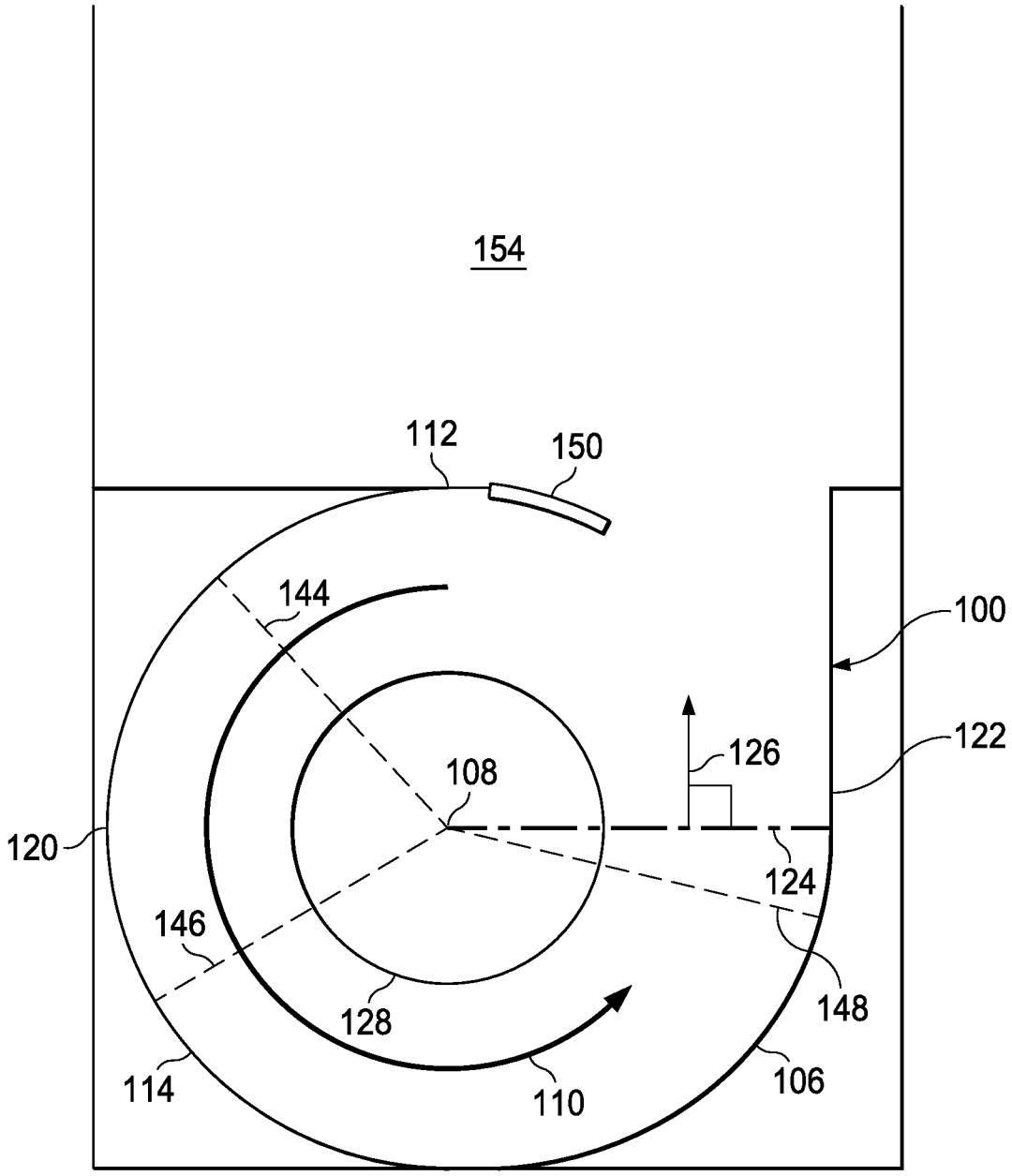
FIG. 2 (PRIOR ART)
FIG. 2 is an orthogonal side view of the blower housing of FIG. 1 in a prior art air handling unit.

Referring now to Prior Art FIGS. 1 and 2, a blower housing 100 of substantially known construction is shown. Most generally, housing 100 is configured to receive a centrifugal blower impeller that may be rotated within an interior space of the housing 100 to move air. Housing 100 comprises a first sidewall 102, a second sidewall 104 generally opposite the first sidewall 102, and a radial wall 106 joining the first sidewall 102 to the second sidewall 104. The housing 100 further comprises a rotation axis 108 and a rotation direction. An above-described blower impeller may be received within the housing 100 and may rotate about the rotation axis 108 in a rotation direction 110 to move air. The housing 100 may further be described as generally comprising a top 112, a bottom 114, a left side 116, a right side 118, a front 120, and a back 122, however, such descriptions are only intended to provide a consistent relative orientation for a viewer FIGS. 1 and 2 and are not intended to limit an interpretation of how, in alternative embodiments, the housing 100 may be oriented in space and/or relative to any other component of an HVAC system.

As most clearly seen in Prior Art FIG. 2, housing 100 further comprises a polar axis 124 that intersects the rotation axis 108 and is generally perpendicular to a discharge direction 126. In some embodiments, the discharge direction 126 may comprise a desired direction of airflow for air that is discharged from the housing 100 while comprising a primarily static pressure and/or substantially homogenous pressure distribution.

In operation of a centrifugal blower comprising housing 100, fluid may be received into an interior space of the housing 100 through at least one of a first inlet 128 and a second inlet 130 and subsequently discharged through discharge 132. In this embodiment, the first sidewall 102 and the second sidewall 104 are substantially similar planar structures that are oriented as mirror images to each other about a central portion of the housing 100. The first inlet 128 and second inlet 130 are generally passages formed in the first and second sidewalls 102, 104, respectively, that comprise generally bell-mouthed and/or otherwise curved first transition 134 to a first inlet edge 136 and substantially similar second transition 138 to a second inlet edge 140. Within the housing 100, fluid may be directed in the rotation direction 110 until it exits the housing through discharge 132.

Discharge 132 may generally be defined as an opening at the top of the housing that would naturally receive airflow with significant vector components of velocity in the discharge direction. In some embodiments, such areas of the housing may extend from a portion of the radial wall 106 that is located near the back 122 of the housing and is substantially parallel to the discharge direction to a portion of the radial wall 106 prior to a downward curvature of the radial wall 106. In other words, in some embodiments, the discharge 132 of the housing 100 may comprise a top 122 portion of the housing 100 that extends between 0 to 90 degrees along the above-described polar coordinate system. In some embodiments, the discharge 132 may comprise a substantially rectangular perimeter 142.

Referring now to Prior Art FIG. 2, first, second, and third radially extending cutting planes 144, 146, and 148 are shown as being coincident with and extending from the rotation axis 108 so that they reach from the rotation axis 108 to the radial wall 106 at locations having relatively increasing angular component polar coordinate values. Angular component polar coordinate values may be represented by the variable, $\Phi$, in this and other embodiments of the disclosure. Accordingly, because the distance of the radial wall 106 from the rotation axis 108 generally increases with increasing angular component polar coordinate values, $\Phi$, the associated areas of the cutting planes 144, 146, 148 within the housing 100 likewise generally increase. Still further, because there is an increasing area of the cutting planes 144, 146, 148 within the housing 100, there is generally an increasing fluid flow area with an increase in angular location in the housing 100. In some embodiments, the generally increasing fluid flow area extends from angular polar coordinate values, $\Phi$, referenced from polar axis 124 of about 70-370 degrees through the use of a so-called cutoff structure 150 that is at least partially disposed within the interior of the housing 100 and that is vertically below the discharge 132. In some embodiments, the approximately 300 degrees of increasing fluid flow area may provide some degree of controlled diffusion of fluid collected while still moving the fluid toward the discharge 132 in a stable manner.

In some embodiments, the housing 100 may provide the above-described increase in fluid flow area with an increase in angular location in the housing 100 according to a known equation or a predetermined rate. For example, in some embodiments, housing 100 may generally be configured so that the above-described increase in fluid flow area substantially adheres to a so-called "Archimedes type" or "arithmetic" type scroll expansion that follows or substantially follows the equation: $A(\Phi)=C*\phi$, where C is a selected constant and $\Phi$ is an angular component value in a polar coordinate system. In other embodiments, housing 100 may generally be configured so that the above-described increase in fluid flow area substantially adheres to a so-called "logarithmic" scroll expansion that follows or substantially follows the equation: $A(\Phi)=C*e^{(D*\Phi)}$, where C and D are selected constants, e is a constant that is the base of the natural logarithm (i.e., equal to about 2.71828), and $\Phi$ is an angular component value in a polar coordinate system.

Figure 3:
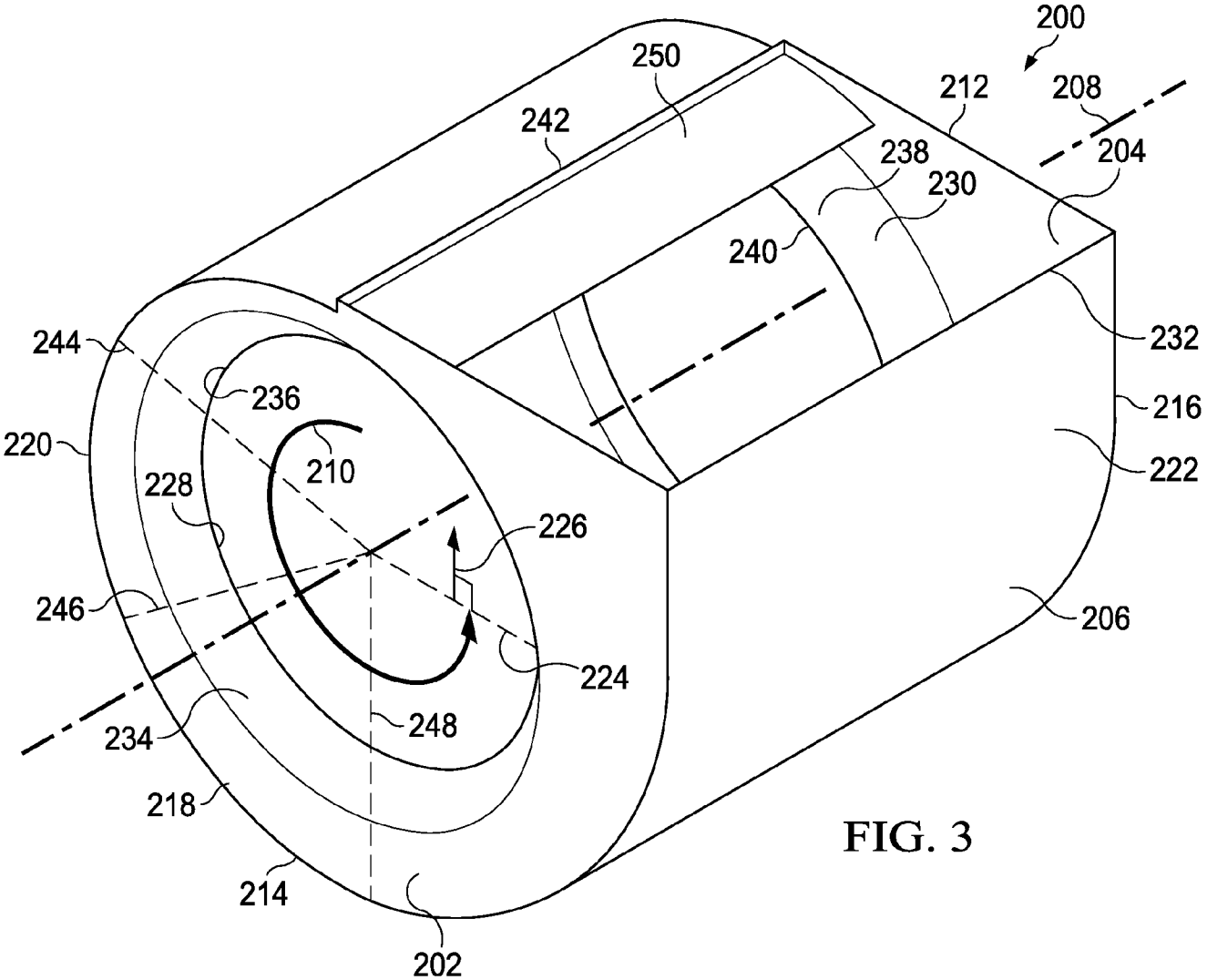
FIG. 3 is an oblique view of a blower housing according to an embodiment of the disclosure.

Referring now to FIG. 3, an oblique view of a blower housing 200 according to an embodiment of this disclosure is shown. Most generally, housing 200 is configured to receive a centrifugal blower impeller that may be rotated within an interior space of the housing 200 to move air. Housing 200 comprises a first sidewall 202, a second sidewall 204 generally opposite the first sidewall 202, and a radial wall 206 joining the first sidewall 202 to the second sidewall 204. The housing 200 further comprises a rotation axis 208 and a rotation direction 210. An above-described blower impeller may be received within the housing 200 and may rotate about the rotation axis 208 in a rotation direction 210 to move air.

The housing 200 may further be described as generally comprising a top 212, a bottom 214, a left side 216, a right side 218, a front 220, and a back 222, however, such descriptions are only intended to provide a consistent relative orientation for a viewer of FIG. 3 and are not intended to limit an interpretation of how, in alternative embodiments, the housing 200 may be oriented in space and/or relative to any other component of an HVAC system. Housing 200 further comprises a polar axis 224 that intersects the rotation axis 208 and is generally perpendicular to a discharge direction 226. In some embodiments, the discharge direction 226 may comprise a desired direction of airflow for air that is discharged from the housing 200 while comprising a primarily static pressure and/or substantially homogenous pressure distribution.

In operation of a centrifugal blower comprising housing 200, fluid may be received into an interior space of the housing 200 through at least one of a first inlet 228 and a second inlet 230 and subsequently discharged through discharge 232. In this embodiment, the first sidewall 202 and the second sidewall 204 are substantially similar structures that are oriented as mirror images to each other about a central portion of the housing 200. The first inlet 228 and second inlet 230 are generally passages formed in the first and second sidewalls 202, 204, respectively, that comprise generally bell-mouthed and/or otherwise curved first transition 234 to a first inlet edge 236 and substantially similar second transition 238 to a second inlet edge 240.

Within the housing 200, fluid may be directed in the rotation direction 210 until it exits the housing through discharge 232. Discharge 232 may generally be defined as an opening at the top of the housing that would naturally receive airflow with significant vector components of velocity in the discharge direction 226. In some embodiments, such areas of the housing may extend from a portion of the radial wall 206 that is located near the back 222 of the housing and is substantially parallel to the discharge direction 226 to a portion of the radial wall 206 prior to a downward curvature of the radial wall 206. In other words, in some embodiments, the discharge 232 of the housing 200 may comprise a top 222 portion of the housing 200 that extends between 0 to 90 degrees along the above-described polar coordinate system. In some embodiments, the discharge 232 may comprise a substantially rectangular perimeter 242.

First, second, and third radially extending cutting planes 244, 246, and 248 are shown as being coincident with and extending from the rotation axis 208 so that they reach from the rotation axis 208 to the radial wall 206 at locations having relatively increasing angular component polar coordinate values, Φ. Accordingly, because the distance of the radial wall 206 from the rotation axis 208 generally increases with increasing angular component polar coordinate values.

The housing 200 may generally be configured so that at least a portion of the above-described increase in fluid flow area substantially adheres to a so-called "inverse circular expansion" (ICE). In some embodiments, ICE may follow or substantially follow the equation:

$$A(\Phi) = A_{co} + R\left(1 - \sqrt{1 - \left[\frac{(r_i)(\Phi)}{R}\right]^2}\right),$$

where A(Φ) is the cross-sectional flow area of the housing 200 as a function of Φ, the an angular component value in a polar coordinate system. $A_{co}$ is the minimum cross-sectional flow area associated with cutoff 250, R is the radius of a first or so-called "driving circle," and $r_i$ is radius of a second or so-called "internal driving circle." In some embodiments, the internal driving circle may be smaller than the driving circle so that $r_i$ is smaller than R. In alternative embodiments, ICE may be defined by and/or accomplished utilizing any other suitable mathematical technique, formula, and/or equation comprising at least a functional component that is at least one of (1) equal to, (2) substantially mathematically reducible to, and (3) substantially mathematically analogous to the equation, $$A(\Phi) = A_{co} + R\left(1 - \sqrt{1 - \left[\frac{(r_i)(\Phi)}{R}\right]^2}\right).$$

For example, in some embodiments, ICE may be defined at least in part by a so-called Taylor series type expression, a Fourier series type expression, and/or any suitable manipulation using trigonometric identities. In other words, alternative embodiments may comprise ICE defined by a function comprising at least a functional component that is at least one of (1) equal to, (2) substantially mathematically reducible to, and (3) substantially mathematically analogous to the equation above so that while the function used to implement ICE is not exactly the same as the ICE equation above, the function used comprises mathematical features that cause expansion at least as a function of the ICE type expansion described above. In some embodiments, substantially all scroll expansion of housing 200 comprises ICE. However, in alternative embodiments, discrete angular sweeps may comprise ICE. For example, in some embodiments, the angular sweep from the second cutting plane 246 to the third cutting plane 248 may be configured to comprise ICE while angular portions of the remainder of the housing 200 may be configured according to any other type of expansion. In yet other embodiments, the housing may comprise a plurality of distinct and/or angularly offset angular sweeps of ICE.

Figure 4:
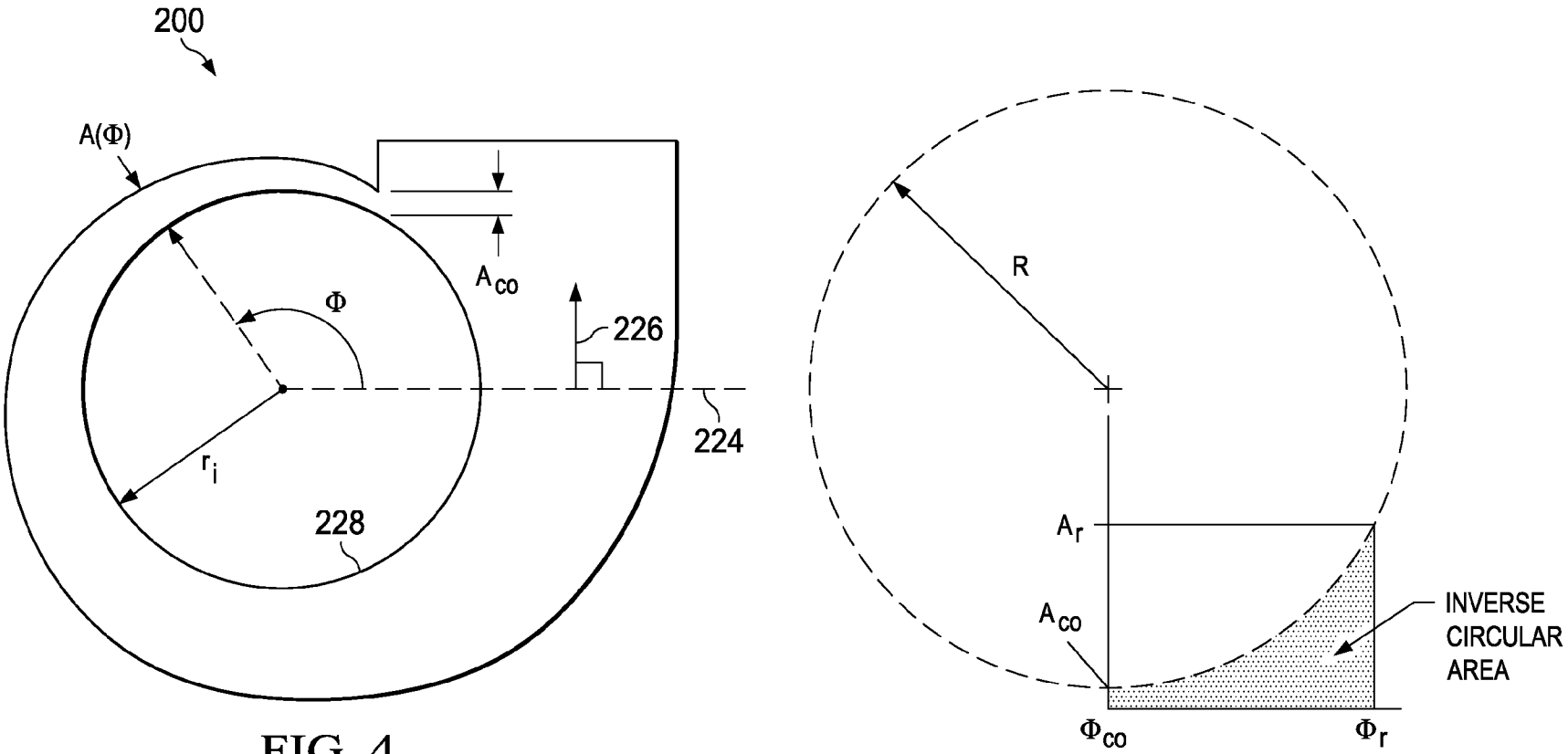
FIG. 4 is a diagram of the blower of FIG. 3 and a geometric schematic labeled to illustrate the variables of an equation by which at least some scroll expansion of the blower of FIG. 3 occurs.
Figure 5:
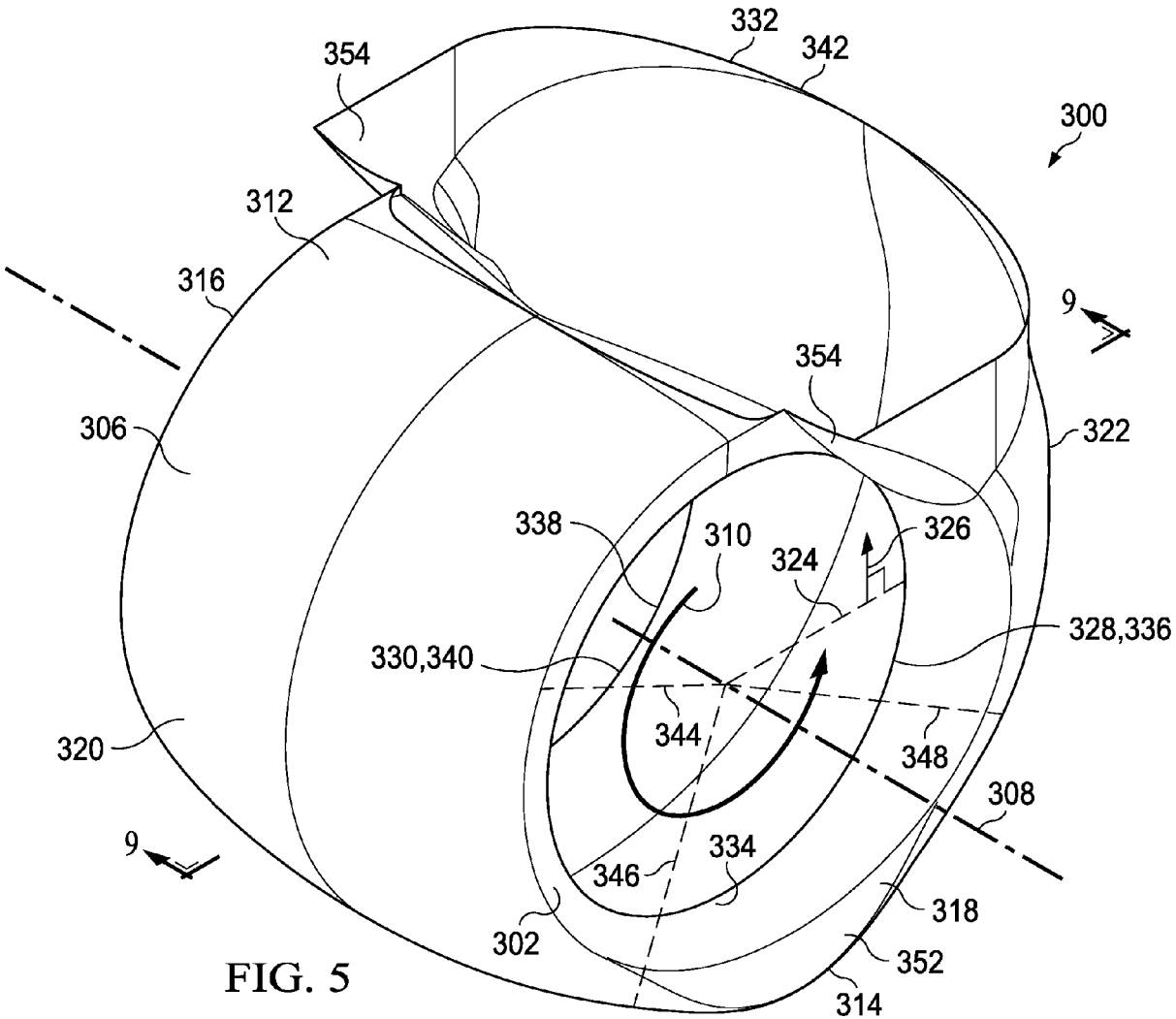
FIG. 5 is an oblique right side view of a blower housing according to another embodiment of the disclosure.
Figure 6:
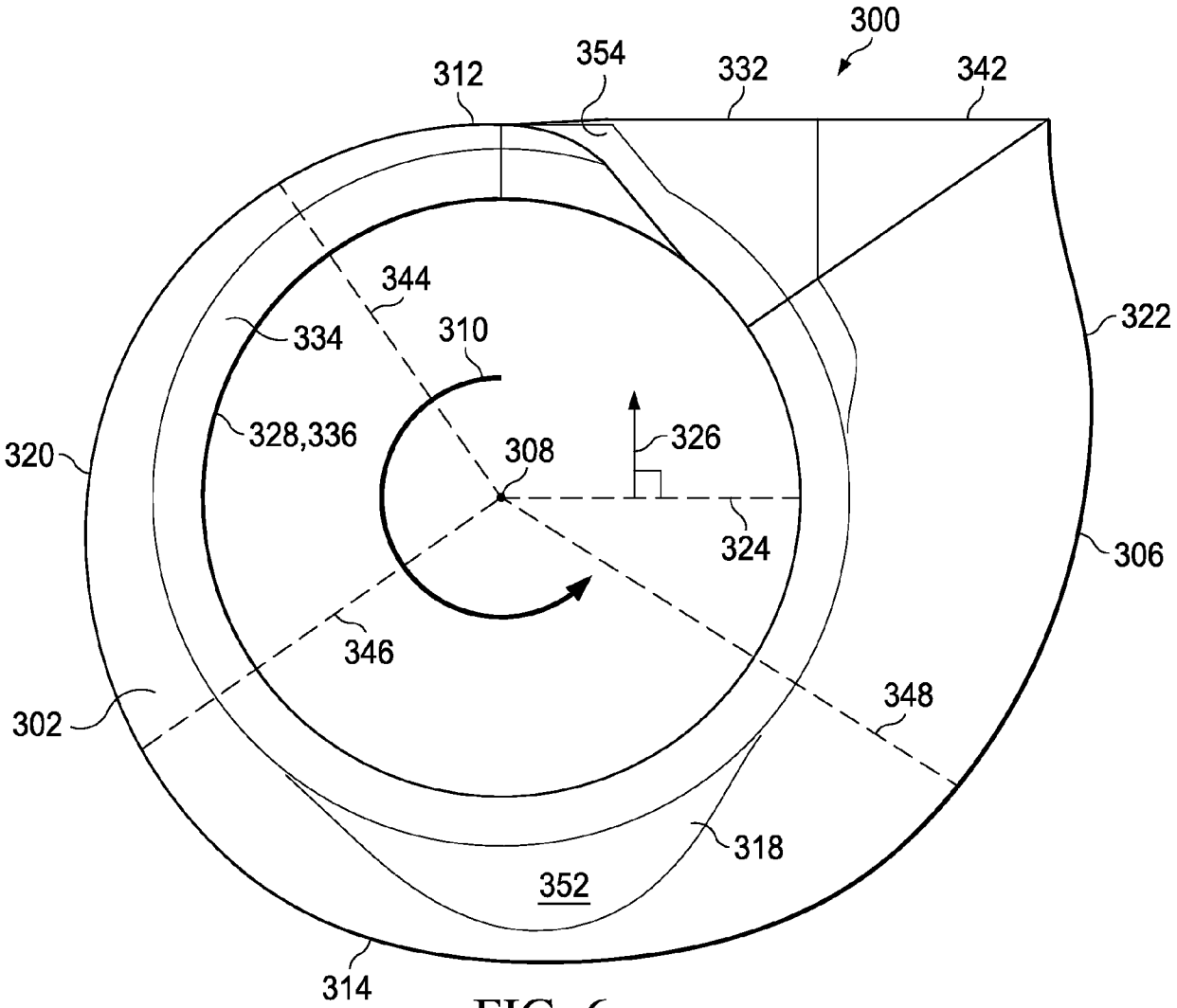
FIG. 6 is an orthogonal right side view of the blower housing of FIG. 5.
Figure 7:
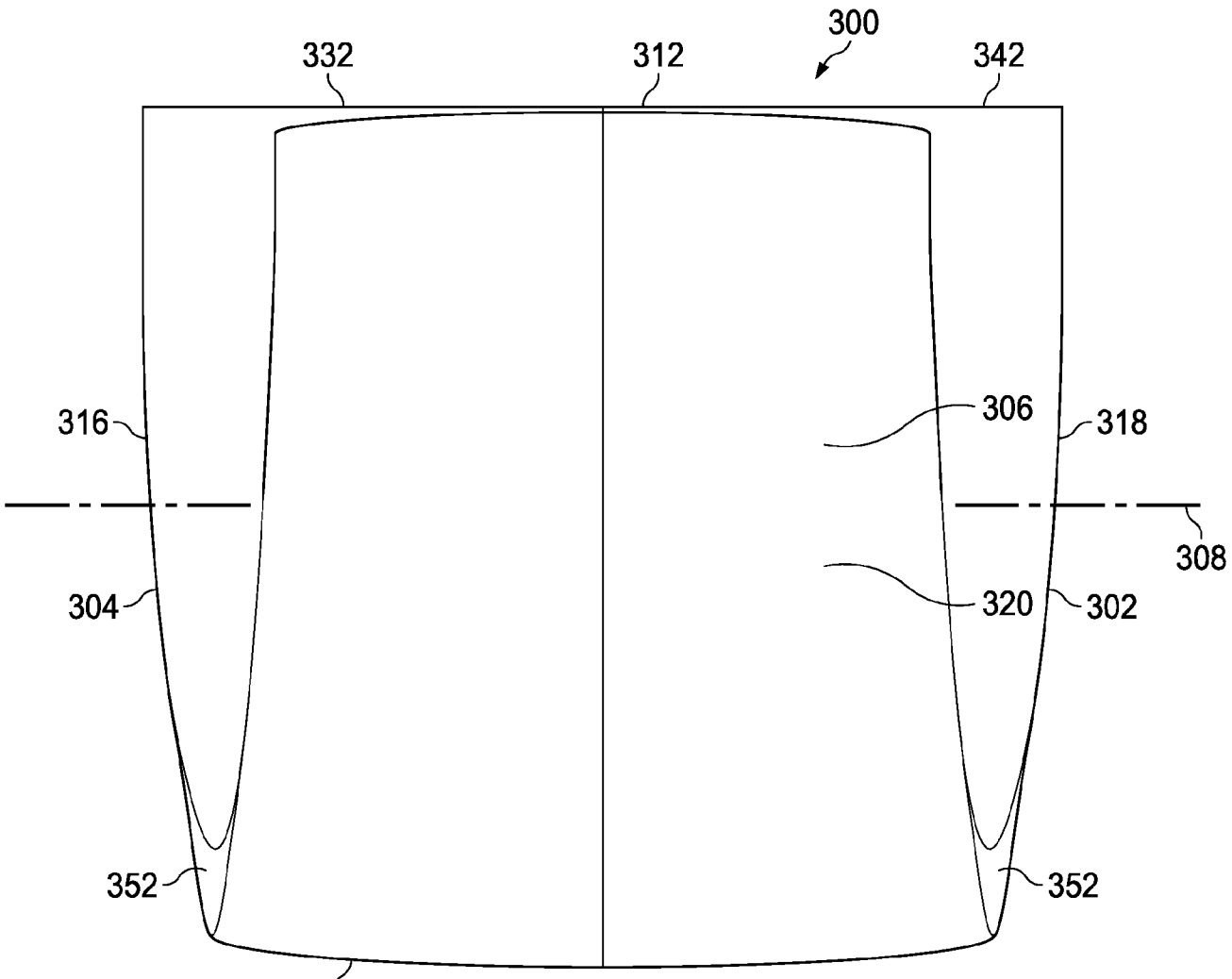
FIG. 7 is an orthogonal front view of the blower housing of FIG. 5.
Figure 8:
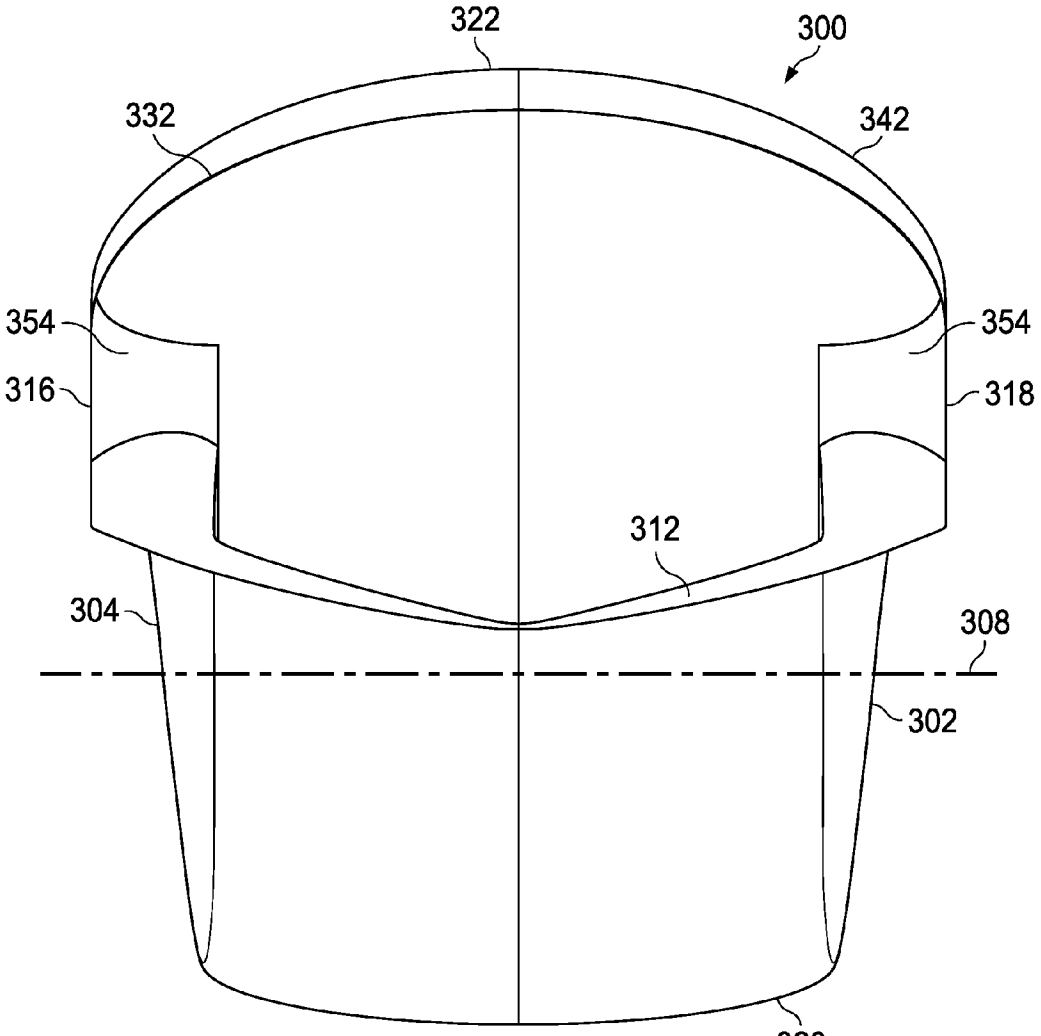
FIG. 8 is an orthogonal top view of the blower housing of FIG. 5.
Figure 9:
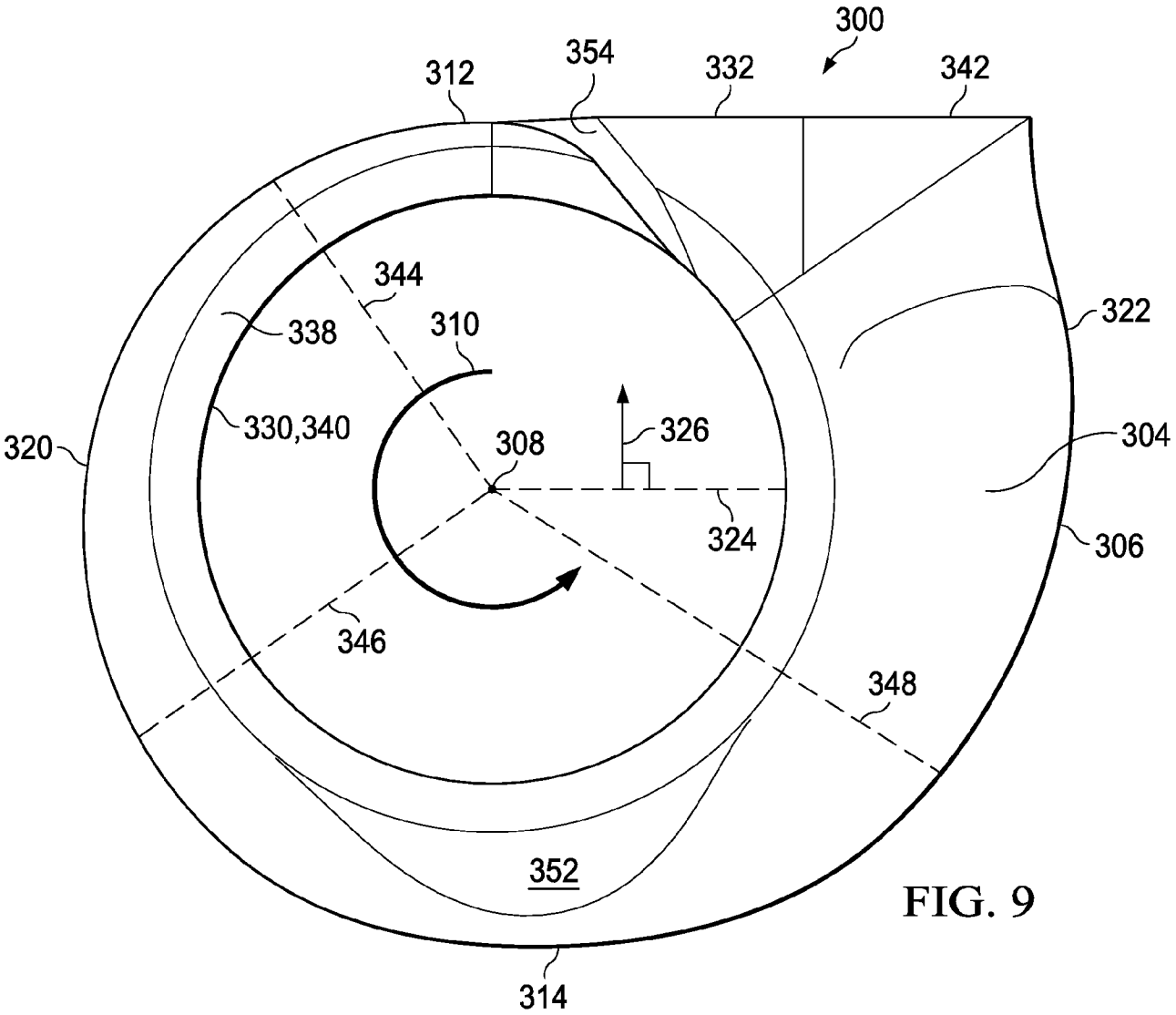
FIG. 9 is an orthogonal cross-sectional view of the blower housing of FIG. 5 as viewed from a right side of the blower housing.

Referring now to FIG. 4, housing 200 is illustrated along with an additional geometric schematic to better illustrate the above-described ICE equation and its variables. Specifically, the housing 200 is shown as comprising the polar axis 224 and discharge direction 226 with the angular component of the polar coordinate system being labeled as Φ. The internal driving circle is labeled as $r_i$ and may generally be associated with the outer diameter of the impeller the housing is designed around. In some embodiments, R and $r_i$ may be selected so that the allowed envelope is not violated, the discharge vector is appropriate, and the scroll remains within the first quadrant of the driving circle of the geometric schematic. In alternative embodiments, ICE may be defined by and/or accomplished utilizing any other suitable mathematical technique, graphical representation, and/or formula that substantially approximates and/or equates to the rate of expansion graphically represented in FIG. 4. In other words, while ICE is described as being related to the rate of expansion associated with a rate of increasing cross-sectional area as a function of the curvature of a portion of the fourth quadrant curve of a circle, this disclosure explicitly contemplates that other alternative embodiments of ICE may follow any other suitable graphical and/or geometric representation while still providing substantially similar expansion rates that may be mathematically reduced to and/or that substantially approximate and/or equate to the rate of expansion graphically represented in FIG. 4. Put another way, while an embodiment of ICE is explicitly defined in terms of the equation, $$A(\Phi) = A_{co} + R\left(1 - \sqrt{1 - \left[\frac{(r_i)(\Phi)}{R}\right]^2}\right),$$

and the graphical representations of FIG. 4 above, this disclosure explicitly recognizes that ICE may be quantified in any other suitable manner substantially consistent with the equations and graphical representations above without departing from the type of expansion of ICE.

Referring now to FIGS. 5-9, a housing 300 according to another embodiment of this disclosure is shown. FIGS. 5-9 are oblique, right, front, top, and cross-sectional views of the housing 300, respectively. Most generally, housing 300 is configured to receive a centrifugal blower impeller that may be rotated within an interior space of the housing 300 to move air. Housing 300 comprises a first sidewall 302, a second sidewall 304 generally opposite the first sidewall 302, and a radial wall 306 joining the first sidewall 302 to the second sidewall 304. However, considering that the overall geometry of housing 300 is substantially more complicated than the geometry of both housings 100, 200, the boundaries of such walls may be less intuitive. Accordingly, for purposes of this discussion, the first sidewall 302 may be defined as comprising all portions of the housing 300 located coincident with and/or axially further outward from a second inlet edge 340 that is described below. Similarly, the second sidewall 304 may be defined as comprising all portions of the housing 300 located coincident with and/or axially further outward from a first inlet edge 336 that is described below. The housing 300 further comprises a rotation axis 308 and a rotation direction 310. An above-described blower impeller may be received within the housing 300 and may rotate about the rotation axis 308 in a rotation direction 310 to move air.

The housing 300 may further be described as generally comprising a top 312, a bottom 314, a left side 316, a right side 318, a front 320, and a back 322, however, such descriptions are only intended to provide a consistent relative orientation for a viewer of FIGS. 5-9 and are not intended to limit an interpretation of how, in alternative embodiments, the housing 300 may be oriented in space and/or relative to any other component of an HVAC system. Housing 300 further comprises a polar axis 324 that intersects the rotation axis 308 and is generally perpendicular to a discharge direction 326. In some embodiments, the discharge direction 326 may comprise a desired direction of airflow for air that is discharged from the housing 300.

In operation of a centrifugal blower comprising housing 300, fluid may received into an interior space of the housing 300 through at least one of a first inlet 328 and a second inlet 330 and subsequently discharged through discharge 332. In this embodiment, the first sidewall 302 and the second sidewall 304 are substantially similar structures that are oriented as mirror images to each other about a central portion of the housing 300. However, unlike the first and second sidewalls 102, 104, the first and second sidewalls 302, 304 are not substantially planar. Instead, the sidewalls 302, 304 generally expand longitudinally and/or axially further outward with increased angular component polar coordinate values. The first inlet 328 and second inlet 330 are generally passages formed in the first and second sidewalls 302, 304, respectively, that comprise generally bell-mouthed and/or otherwise curved first transition 334 to a first inlet edge 336 and substantially similar second transition 338 to a second inlet edge 340. In some embodiments, the transitions 334, 338 may generally expand longitudinally and/or axially further outward with increased angular component polar coordinate values. Such above-described axial expansions may result in an increase in fluid flow area with increased angular component polar coordinate values. Within the housing 300, fluid may be directed in the rotation direction 310 until it exits the housing through discharge 332. Discharge 332 may generally be defined as an opening at the top of the housing that would naturally receive airflow with significant vector components of velocity in the discharge direction 326. In some embodiments, such areas of the housing may extend from a portion of the radial wall 306 that is located near the back 322 of the housing and is substantially parallel to the discharge direction 326 to a portion of the radial wall 306 prior to a downward curvature of the radial wall 306. In other words, in some embodiments, the discharge 332 of the housing 300 may comprise a top 322 portion of the housing 300 that extends between 0 to 90 degrees along the above-described polar coordinate system.

First, second, and third radially extending cutting planes 344, 346, and 348 are shown as being coincident with and extending from the rotation axis 308 so that they reach from the rotation axis 308 to the radial wall 306 at locations having relatively increasing angular component polar coordinate values. Accordingly, because the distance of the radial wall 306 from the rotation axis 308 generally increases with increasing angular component polar coordinate values and because of the above-described axial expansion of the first and second sidewalls 302, 304, the associated area of the cutting planes 344, 346, 348 within the housing 300 likewise generally increases. Still further, because there is an increasing area of the cutting planes 344, 346, 348 within the housing 300, there is generally an increasing fluid flow area with an increase in angular location in the housing 300. In some embodiments, the generally increasing fluid flow area extends from angular polar coordinate values of about 90-390 degrees, thereby eliminating any need for a so-called cutoff structure that may be at least partially disposed within the interior of the housing 300 and that may be vertically below the discharge 332.

The housing 300 may generally be configured so that at least a portion of the above-described increase in fluid flow area substantially adheres to the "inverse circular expansion" (ICE) that follows or substantially follows the equation, $$A(\Phi) = A_{co} + R\left(1 - \sqrt{1 - \left[\frac{(r_i)(\Phi)}{R}\right]^2}\right),$$

described above with regard to housing 200 and FIGS. 3 and 4. In some embodiments, the internal driving circle may be smaller than the driving circle so that $r_i$ is smaller than R. In some embodiments, substantially all scroll expansion of housing 300 comprises ICE. However, in alternative embodiments, discrete angular sweeps may comprise ICE. For example, in some embodiments, the angular sweep from the second cutting plane 346 to the third cutting plane 348 may be configured to comprise ICE while angular portions of the remainder of the housing 200 may be configured according to any other type of expansion. In yet other embodiments, the housing may comprise a plurality of distinct and/or angularly offset angular sweeps of ICE.

Further, the housing 300 comprises somewhat flattened expansion zones 352 where overall fluid flow area is increased not only by increasing a distance of radial wall 306 from rotation axis 308 but by also locally axially expanding portions of first sidewall 302 and second sidewall 304. Further expansion of fluid flow area occurs angularly thereafter in a manner configured to control diffusion by via a decreasing reliance on flattened expansion zones 352 and an increasing reliance on an increasing distance between radial wall 306 from rotation axis 308. In other words, flattened expansion zones 352 may taper off as angular location increases and in conjunction with such tapering off, radial wall 306 may more aggressively be distanced from the rotation axis 308.

Still further, housing 300 may comprise a perimeter 342 that is not substantially rectangular. As shown best in FIGS. 5 and 8, the perimeter 342 may comprise curved boundaries and may further have structural webs 354 that join a front portion of perimeter 342 to a relatively axially substantially slimmer portion of the housing near the 90 degree angular location.

Figure 10:
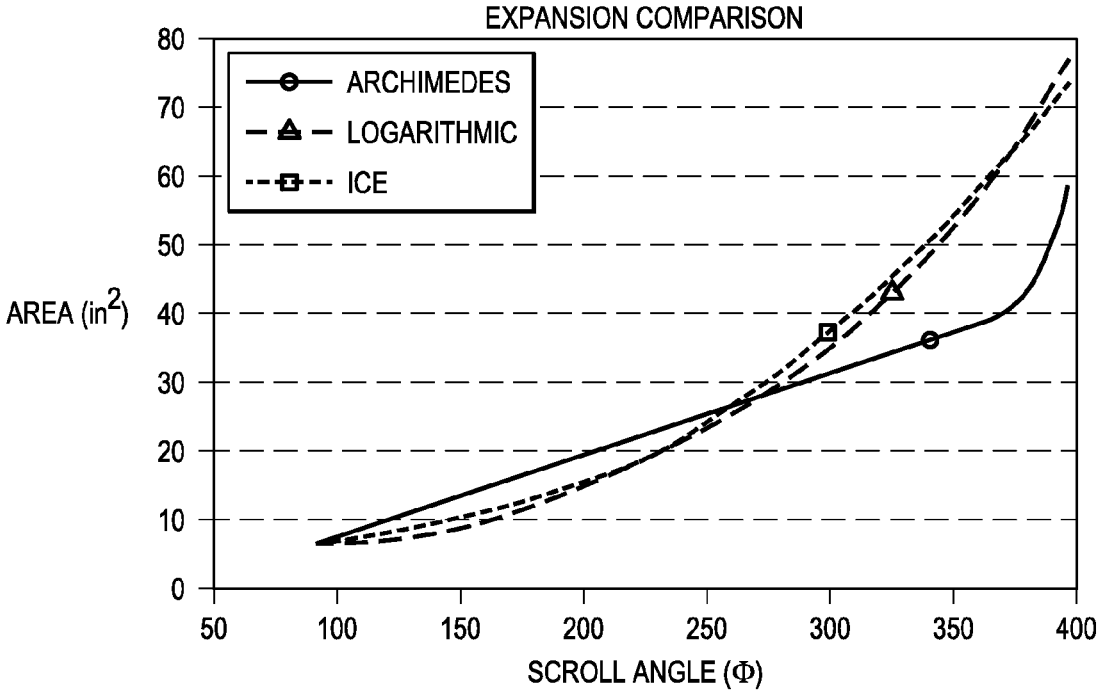
FIG. 10 is a chart showing area expansion of a blower housing according to the disclosure as compared to area expansion of prior art blower housings.

Referring now to FIG. 10, the flow path area expansion of a housing primarily comprising ICE is compared to the flow path area expansion of (1) a housing comprising area expansion primarily comprising Logarithmic type expansion and to (2) a housing comprising area expansion primarily comprising Archimedes type expansion. Each of the three housings represented are designed to fit the same physical size envelope and to deliver substantially the same airflow and pressure rises.

Figure 11:
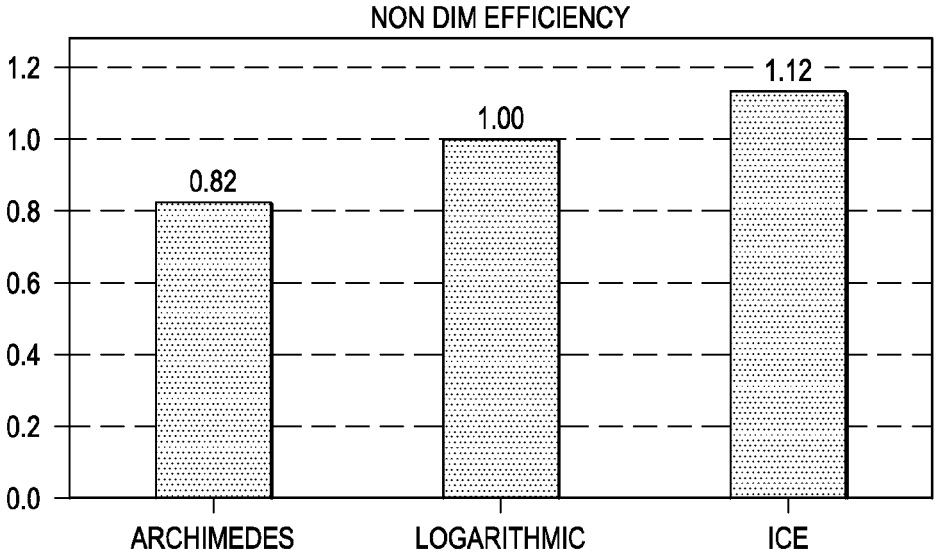
FIG. 11 is a chart showing efficiency of a blower housing according to the disclosure as compared to efficiency of prior art blower housings.

Referring now to FIG. 11, the non-dimensional efficiency of a housing primarily comprising ICE is compared to the non-dimensional efficiency of (1) a housing comprising area expansion primarily comprising Logarithmic type expansion and (2) a housing comprising area expansion primarily comprising Archimedes type expansion. It is shown that in some embodiments, the non-dimensional efficiency of the housing comprising ICE is 1.12 while the non-dimensional efficiencies of a Logarithmic housing and an Archimedes housing are 1.00 and 0.82, respectively. In some embodiments, the efficiency advantage of the ICE housing may be attributable to improved post-housing diffusion which may reduce noise and improve performance of downstream components such as heat exchangers. In particular, the ICE housing causes improved diffusion a shorter distance from the discharge of the housing as compared to the other housings. Further, in some embodiments, the efficiency advantage of the ICE housing may be attributable to a lower peak velocity within the housing as compared to the other housings, particularly in the early stages of scroll expansion. Still further, in some embodiments, the efficiency advantage of the ICE housing may be attributable to a more uniform velocity distribution of fluid entering the inlet as compared to the other housings.

Most generally, the housings 200, 300 are configured to improve fluid flow characteristic relative to substantially similar housings that do not comprise ICE. While the discussion above generally refers to fluid flow areas within the housings as comprising plane areas that extend radially from axes of rotation to interior walls of the housing, alternative embodiments may define such fluid flow areas differently. In some embodiments, fluid flow areas may comprise the above described fluid flow areas minus area occupied by an impeller associated with the housing. In still other embodiments, fluid flow areas may comprise the above described fluid flow areas minus the areas occupied by a volume bounded by the opposing inlet edges. It will be appreciated that while there are many ways to define the measurement of fluid flow areas, in some embodiments, some important aspects may be generally related to overall trends in fluid flow areas relative to angular location on the above-described polar coordinate system and an established relationship to the equations that dictate ICE.

While some embodiments described above comprise about 300 degrees of controlled expansion, it will be appreciated that blower housings of other alternative embodiments which may comprise alternative shapes, sizes, and/or specifications related to pressure performance may ideally require more or fewer degrees of controlled expansion. In general, the more pressure the blower must work against to deliver fluid flow, the more controlled expansion (as measured angularly) is required to achieve an optimal design. In cases where too much controlled expansion (as measured angularly) is implemented, blower efficiency may be decreased. In cases where too little controlled expansion (as measured angularly) is implemented, fluid flow is destabilized. Accordingly, alternative embodiments of blower housings may comprise different characteristics related to how many angular degrees of controlled expansion are selected, but nonetheless, any of such alternative embodiments may still benefit from comprising ICE. As such, any blower housing comprising a portion of controlled expansion defined as a function of ICE as defined herein is within the scope of this disclosure.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A blower housing, comprising:

a discharge direction;

an axis of rotation;

a polar axis that intersects the axis of rotation and is substantially perpendicular to the discharge direction; and an angular sweep of increasing fluid flow area, wherein the fluid flow area increases with increasing angular magnitude with respect to the polar axis.

2. The blower housing of claim 1, wherein the angular sweep extends over about 300 degrees.

3. The blower housing of claim 1, wherein the angular sweep begins at about 90 degrees as measured from the polar axis.

4. The blower housing of claim 1, wherein the angular sweep ends at about 365 degrees as measured from the polar axis.

5. The blower housing of claim 1, wherein the fluid flow area comprises a cross-sectional area measured between the axis of rotation and an inner wall of the blower housing.

6. The blower housing of claim 1, wherein the fluid flow area is increased by increasing a distance between the axis of rotation and a radial wall of the blower housing.

7. The blower housing of claim 1, wherein the fluid flow area is increased by axially expanding a sidewall of the blower housing.

8. The blower housing of claim 1, wherein the housing comprises an axial contraction between the angular sweep and a discharge of the blower housing.

9. The blower housing of claim 1, wherein the angular sweep extends to a discharge of the blower housing.

10. The blower housing of claim 3, wherein the angular sweep is angularly separated from a discharge of the blower housing that extends from about 0 degrees to about 90 degrees.

11. A method of moving air, comprising:

receiving fluid into a centrifugal blower; and moving the fluid along an angular path; and increasing the fluid flow cross-sectional area of the angular path with increasing angular magnitude prior to a discharge opening; and discharging the fluid through the discharge opening in an airflow direction that is substantially tangential to a polar axis of the centrifugal blower.

12. The method of claim 11, wherein the discharge opening extends between about 0 degrees and about 90 degrees with respect to the polar axis, and wherein increasing the fluid flow cross-sectional area of the angular path begins at about 90 degrees with respect to the polar axis.

13. The method of claim 11, wherein the angular path of increasing fluid flow area comprises about 300 degrees.

14. The method of claim 11, wherein the increasing fluid flow area comprises an increasing axial dimension of a sidewall of the centrifugal blower.

15. The method of claim 11, wherein the increasing fluid flow area comprises increasing a radial dimension of a radial wall from an axis of rotation of the centrifugal blower.

16. A centrifugal blower housing, comprising:

a first sidewall comprising a first inlet;

a second sidewall substantially opposite the first sidewall, the second sidewall comprising a second inlet;

a radial wall joining the first sidewall to the second sidewall, the radial wall comprising a discharge;

a discharge direction;

a polar axis that intersects an axis of rotation of the blower housing and extends substantially perpendicular to the discharge direction; and an angular sweep of increasing fluid flow area, wherein the increasing fluid flow area comprises increasing the distance of the radial wall from the axis of rotation increases with an increasing angular magnitude with respect to the polar axis.

17. The centrifugal blower housing of claim 16, wherein the first angular sweep extends about 300 degrees with respect to the polar axis.

18. The centrifugal blower housing of claim 16, wherein the first angular sweep begins at about 90 degrees with respect to the polar axis.

19. The centrifugal blower housing of claim 16, wherein the first angular sweep is angularly adjacent a second angular sweep that increases at a substantially different rate than the first angular sweep.

20. The centrifugal blower housing of claim 19, wherein the second angular sweep is angularly offset from at least one of the first angular sweep and the discharge.

* * * * *